US007845958B2

(12) United States Patent
Hoshino et al.

(10) Patent No.: US 7,845,958 B2
(45) Date of Patent: Dec. 7, 2010

(54) CONNECTOR

(75) Inventors: Hirokazu Hoshino, Tokorozawa (JP); Yusuke Shimura, Okayama (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 12/425,939

(22) Filed: Apr. 17, 2009

(65) Prior Publication Data

US 2009/0280658 A1 Nov. 12, 2009

(30) Foreign Application Priority Data

May 12, 2008 (JP) ..... 2008-124708

(51) Int. Cl.
*H01R 12/00* (2006.01)

(52) U.S. Cl. ..... 439/74; 439/660

(58) Field of Classification Search ..... 439/65, 439/74, 660

See application file for complete search history.

(56) References Cited

U.S. PATENT DOCUMENTS 7,484,969 B2 * 2/2009 Shiu ..... 439/74

FOREIGN PATENT DOCUMENTS

JP 2004-055463 A 2/2004

* cited by examiner

*Primary Examiner*—Khiem Nguyen
(74) *Attorney, Agent, or Firm*—Osha Liang LLP

(57) ABSTRACT

A connector has a plug mounted on a lower surface of a printed circuit board, and a socket mounted on an upper surface of another printed circuit board. The plug is fitted in and electrically connected to the socket. A second support fitting is attached to both ends of a plug main body of the plug and is fixed to the printed circuit board. A first support fitting is attached to both ends of a socket main body of the socket and fixed to the another printed circuit board. The second support fitting is engaged to the first support fitting.

7 Claims, 18 Drawing Sheets

CONNECTOR

BACKGROUND OF THE INVENTION

1. Technical Field

The present invention relates to connectors, and in particular, to a connector for electrically connecting the opposing printed circuit boards.

2. Related Art

Conventionally, a connector in which a plug mounted on a lower surface of a printed circuit board is fitted into a socket mounted on an upper surface of another printed circuit board to electrically connect the printed circuit boards has been known (see Japanese Unexamined Patent Publication No. 2004-55463).

SUMMARY

In the above-described connector, however, a projection 47 of a reinforcement fitting 46 projecting out from a short side of a body 41 of a header 40 serving as a plug is engaged to a lock engagement recessed portion on a body 21 side of a socket 20 for retention. Thus, the entire length of the header 40 becomes long, and consequently, the floor area of the entire connector becomes large.

The reinforcement fitting 46 of the header 40 to be soldered to one printed circuit board engages the body 21 of the socket 20, but the socket 20 is insert molded with a reinforcement fitting 32 to be soldered to the other printed circuit board. That is, the reinforcement fitting 32 soldered to one printed circuit board is connected to the reinforcement fitting 46 soldered to the other printed circuit board by way of the body 21 of the socket 20. Thus, the distance between the opposing surfaces of the printed circuit boards tends to vary due to variation in part precision and assembly precision. As a result, the connection state between the socket 20 and the header 40 tends to vary, thereby lowering the contact reliability.

The present invention has been devised to solve the problems described above, and an object thereof is to provide a connector having a small floor area and high contact reliability.

In accordance with one aspect of the present invention, in order to achieve the above object, the present invention is directed to a connector for fitting in and electrically connecting a plug mounted on a lower surface of a printed circuit board to a socket mounted on an upper surface of another printed circuit board; wherein a second support fitting attached to both ends of a plug main body of the plug and fixed to the printed circuit board is engaged to a first support fitting attached to both ends of a socket main body of the socket and fixed to the another printed circuit board.

According to the present invention, retention is realized by mutually engaging the first support fitting and the second support fitting, and thus the length dimension of the connector becomes larger by the plate thickness of the first support fitting. Thus, a connector having a smaller floor area than a related art is obtained.

As the first support fitting and the second support fitting fixed to the printed circuit boards are directly engaged, the influence due to variation in part precision and assembly precision becomes small. Thus, the variation in the distance between the opposing surfaces of the printed circuit board becomes small, the variation does not arise in the connection state of the socket and the plug, and a connector of high contact reliability is obtained.

In an embodiment of the present invention, a lock nail provided at a free end of an elastic arm extending from at least an edge on one side of the second support fitting may lock to a lock receiving portion provided on an inner side surface of at least one side of the opposing inner side surface of the first support fitting. In particular, the lock nail provided at the free end of the elastic arm extending from edges on both sides of the second support fitting may lock to the lock receiving portion provided on the opposing inner side surface of the first support fitting.

According to the present embodiment, the plug is prevented from coming off due to warp and twist since four corners of the connector are locked, and the contact reliability can be enhanced.

In another embodiment of the present invention, the lock nail of the second support fitting may lock to the lock receiving portion of the first support fitting to obtain a click feeling.

According to the present embodiment, the connection of the plug and the socket can be checked by the click feeling obtained when fitting the plug to the socket, and a connector that gives a sense of safety can be obtained.

In still another embodiment of the present invention, a positioning projection which engages the plug main body for retention may be formed at the edges on both sides of a positioning projecting portion formed by performing extrusion processing on the second support fitting and fitted to a guide groove of the plug main body.

According to the present embodiment, the second support fitting is strongly fixed to the plug main body, and the contact reliability further improves.

In yet another embodiment of the present invention, a positioning projecting portion on a lower side may have a narrower width than a positioning projecting portion on an upper side of the pair of positioning projecting portions formed above and below by performing extrusion processing on the second support fitting and fitted to the guide groove of the plug main body.

According to the present embodiment, the pair of positioning projecting portions of the second support fitting are more easily assembled to the guide groove of the plug main body, and a connector of high productivity is obtained.

A push-in amount of a first terminal for electrical connection may be the same as a push-in amount of the first support fitting for retention.

According to the present embodiment, a connector in which the electrical connection and the retention tasks are simultaneously performed can be obtained.

DETAILED DESCRIPTION

Hereinafter, preferred embodiments of the connector according to the present invention will be described with reference to the accompanying drawings FIGS. 1 to 18C.

As shown in FIGS. 1 to 4, the connector according to the present embodiment includes a socket 20 connected to an upper surface of a printed wiring assembly 10, and a plug 50 connected to a lower surface of a printed wiring assembly 11.

Figure 4:
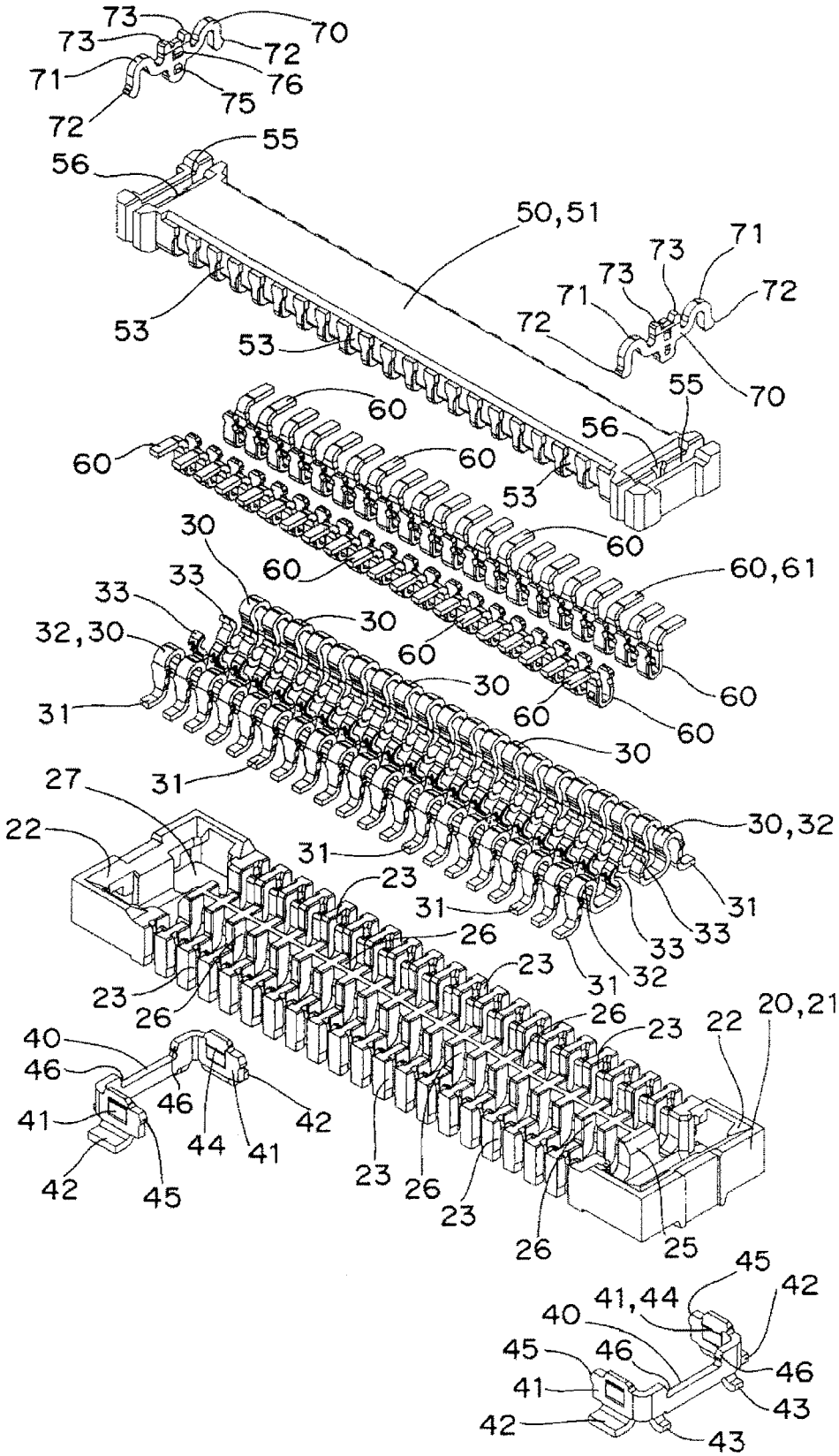
FIG. 4 is an exploded perspective view of the connector according to the present invention shown in FIGS. 3A and 3B.

As shown in FIG. 4, the socket 20 is formed by adjacently arranging a plurality of first terminals 30 along the opposing opening edges of a socket main body 21, and assembling a first support fitting 40 to both end edges of the bottom surface.

Figure 5A:
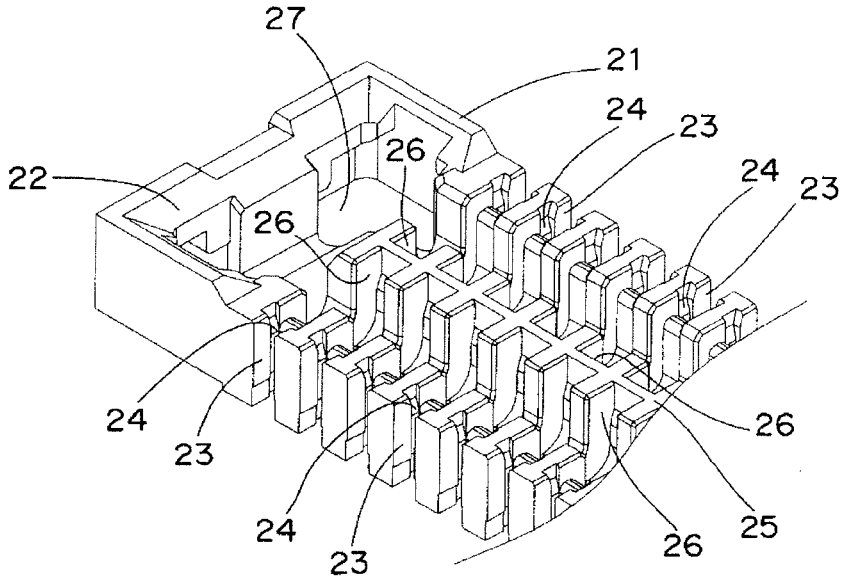
FIGS. 5A, 5B, and 5C are a partial perspective view, a partial front view, and a partial perspective view seen from a different angle of a socket main body according to the present invention.
Figure 5B:
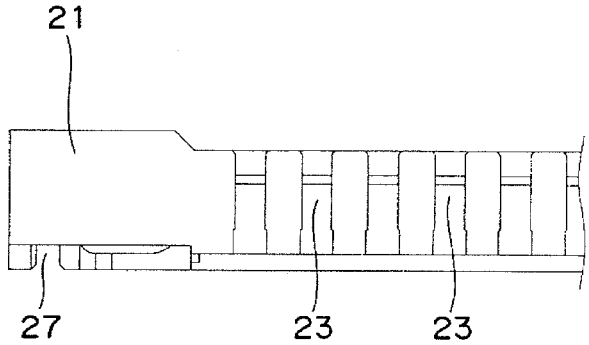
Figure 5C:
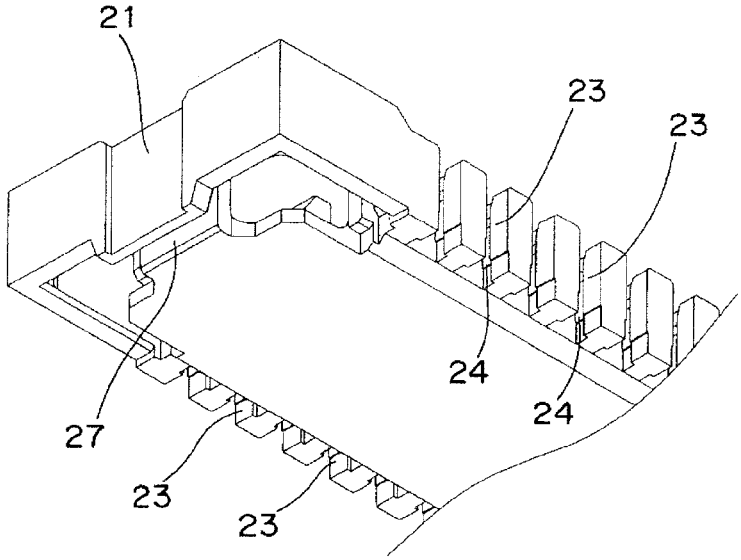
Figure 6A:
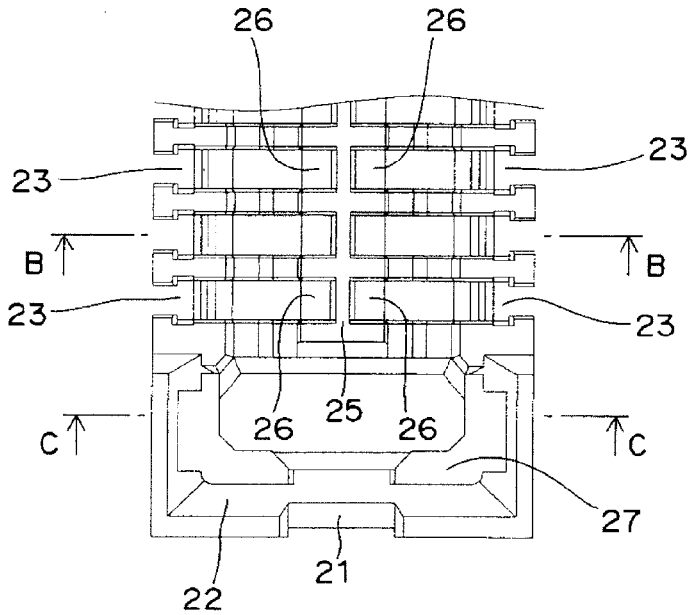
FIGS. 6A, 6B, and 6C are partial plan view of the socket main body according to the present invention, and cross-sectional views taken along line B-B and line C-C in FIG. 6A.
Figure 6B:
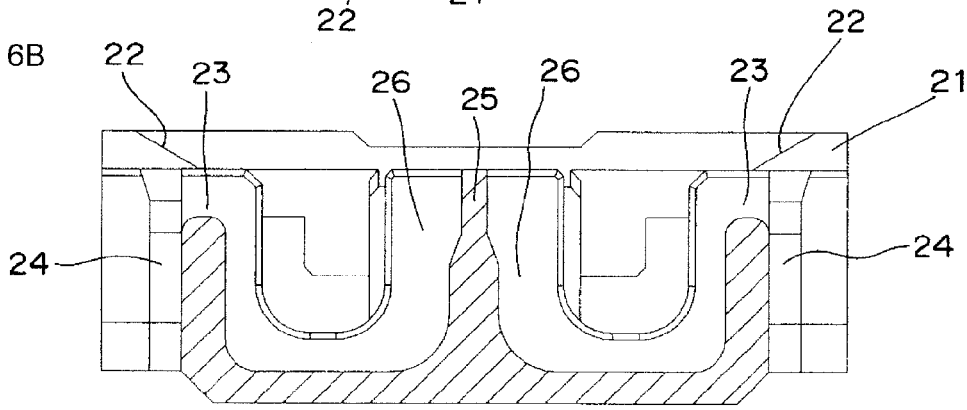

As shown in FIGS. 5A to 5C, the socket main body 21 is formed in a box-shape having a shallow bottom, where a guide tapered surface 22 is formed at both end edges of the opening, and a substantially U-shaped press-fit groove 23 for press-fitting the first terminal 30, to be hereinafter described, is adjacently arranged at a predetermined pitch on the opposing side walls. In particular, as shown in FIG. 6B, a pair of retention ribs 24 is arranged in a projecting manner at the opposing inner side surfaces positioned on the outward side of the press-fit groove 23. It should be recognized that the guide tapered surface 22 may be a radiused surface.

The socket main body 21 also has a partitioning wall 25 of plane rectangular shape arranged in a projecting manner at the middle of the bottom surface. The partitioning wall 25 has, on its outer peripheral surface, a substantially L-shaped fit-in groove 26 communicating to the press-fit groove 23 adjacently arranged at a position corresponding to the press-fit groove 23. In particular, the fit-in groove 26 has a wider width than an elastic contact piece 33 of the first terminal 30.

Figure 6C:
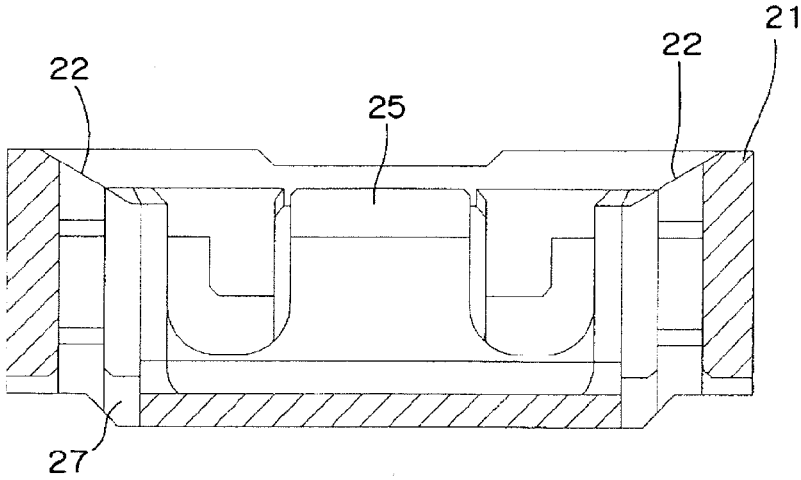

Furthermore, as shown in FIG. 5C, the socket main body 21 is formed with an insertion groove 27 of a substantially plane horseshoe-shape for inserting a first support fitting 40, to be hereinafter described, at both end edges of the bottom surface. The insertion groove 27 has both ends communicating to the socket main body 21 (FIG. 6C).

As shown in FIGS. 7A to 7D, the first terminal 30 is formed with a first press-fit portion 32 by bending the portion extending from a first connecting portion 31 to a substantially Ω-shape. The first press-fit portion 32 has an outer peripheral surface that is positioned on the inward side and that is inclined as a first contact 32*a*.

Furthermore, a portion extending from the end on the inward side of the first press-fit portion 32 is bent up to form an elastic contact piece 33. The elastic contact piece 33 has second contacts 33*a*, 33*a* of a twin-dimple structure projecting out at the opposing surface of the free end curved towards the first press-fit portion 32 side. Thus, the second contact 33*a* faces the first contact 32*a*.

Retention projections 35, 35 are formed on both side edges on the outward side of the first press-fit portion 32. The Ni plating (not shown) is performed on the base on the outward side of the first press-fit portion 32 to prevent rise of the solder.

As shown in FIGS. 8A to 8D, the first support fitting 40 has a substantially plane horseshoe-shape, where a first fixing portion 42 is extended from the edge on the lower side of opposing arms 41, and a second fixing portion 43 is extended at positions adjacent thereto. The arm 41 has a click-feeling projection 44 formed on the opposing surfaces, where an engagement projection 45 is formed at the distal end surface. The first support fitting 40 is provided with a pair of engagement projections 46, 46 so as to face each other at the central part.

Figure 9A:
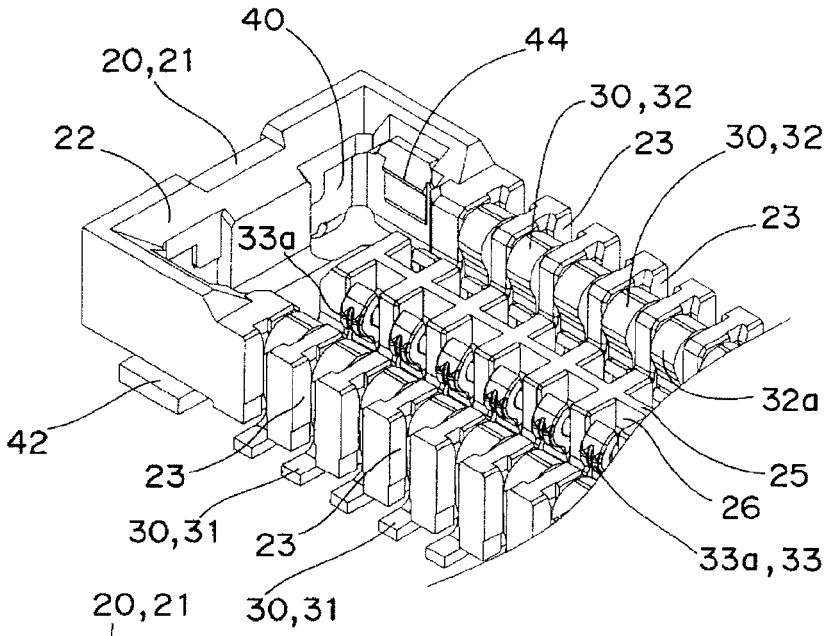
FIGS. 9A, 9B, and 9C are a partial perspective view, a partial front view, and a partial perspective view seen from a different angle of a socket main body assembled with the first terminal and the first support fitting.
Figure 9B:
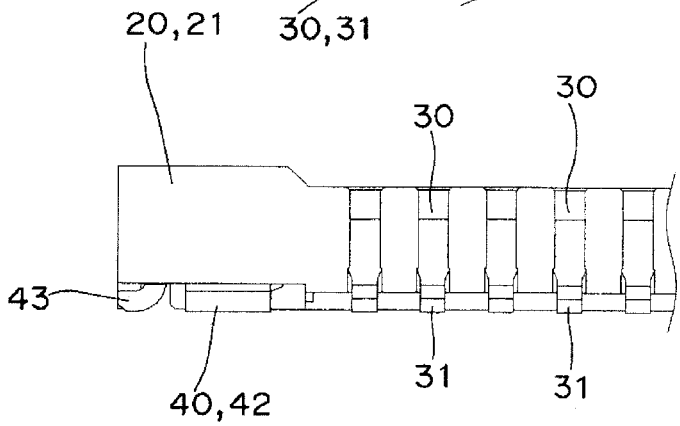
Figure 9C:
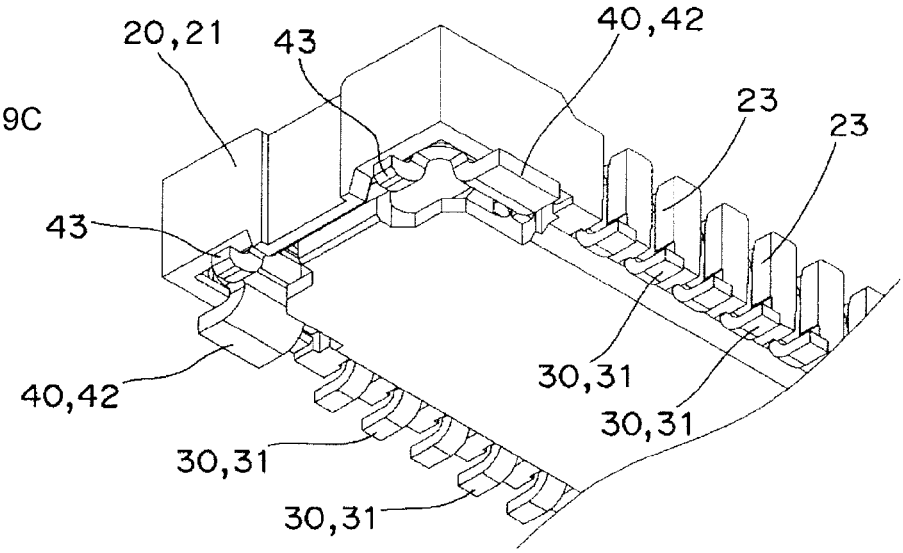

As shown in FIGS. 9A to 9C and FIGS. 10A to 10C, the first press-fit portion 32 of the first terminal 30 is press-fit to the press-fit groove 23 of the socket main body 21, and the retention projection 35 is locked to the retention ribs 24, 24 of the press-fit groove 23 for retention (FIG. 9A). The first support fitting 40 is inserted to the insertion groove 27 of the socket main body 21, and the engagement projections 45, 46 is engaged to the socket main body 21 for retention (FIG. 9C).

Figure 10A:
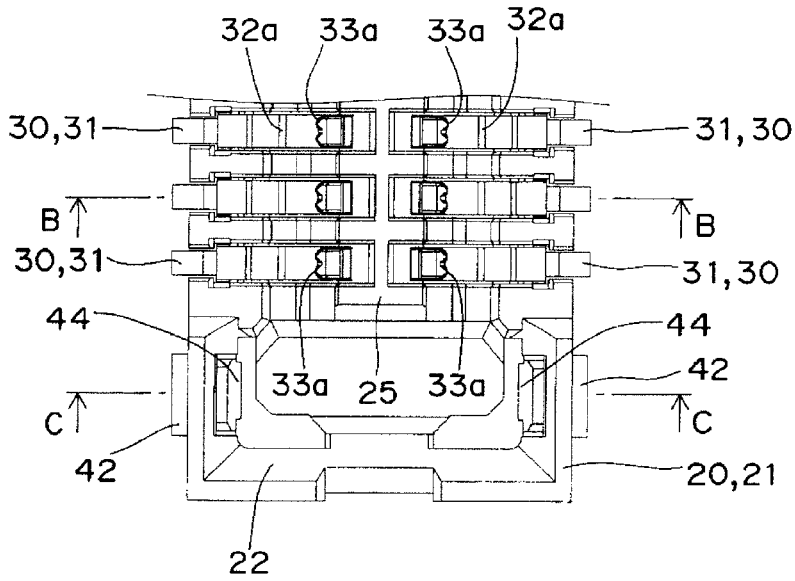
FIGS. 10A, 10B, and 10C are a partial plan view of a socket in which the first terminal and the first support fitting are assembled to the socket main body, and cross-sectional views taken along line B-B and line C-C in FIG. 10A.
Figure 10B:
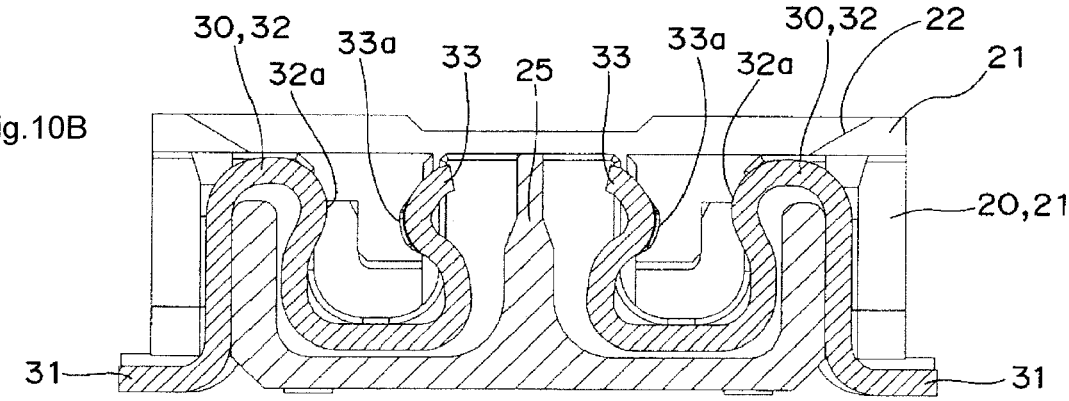
Figure 10C:
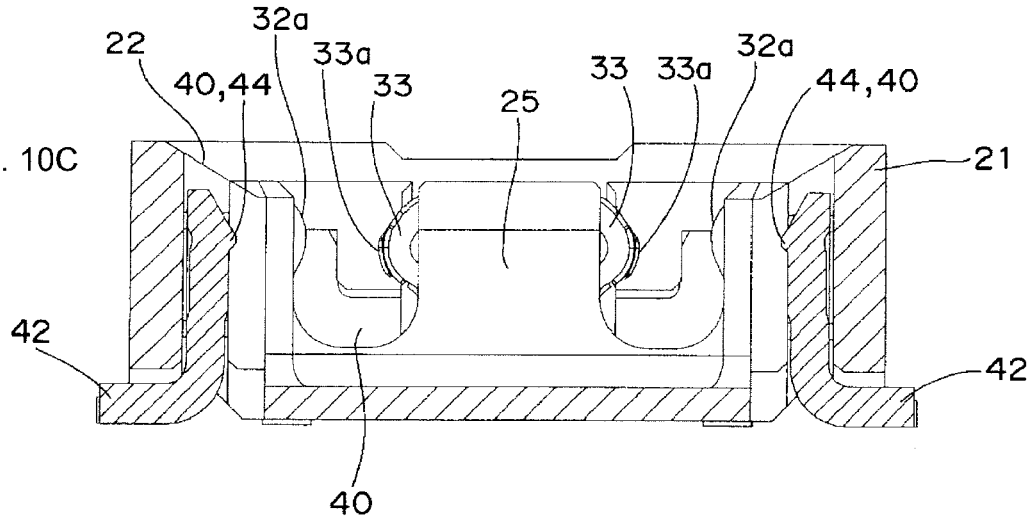
Figure 11A:
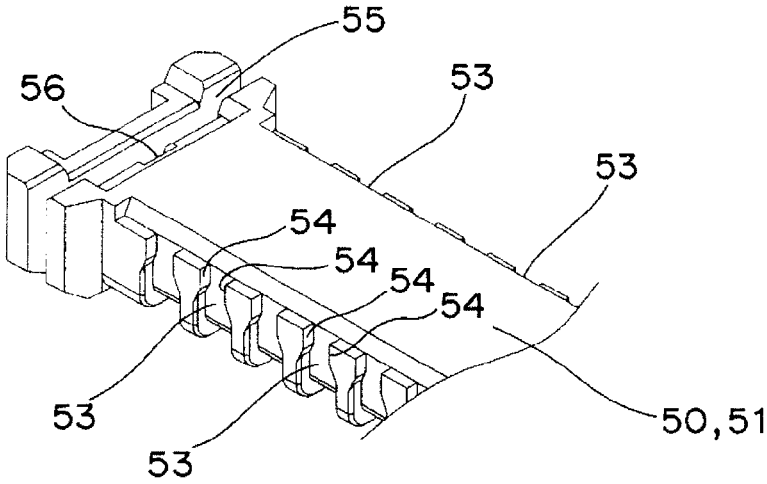
FIGS. 11A, 11B, and 11C are a partial perspective view, a partial front view, and a partial perspective view seen from a different angle of a plug main body according to the present invention.
Figure 11B:
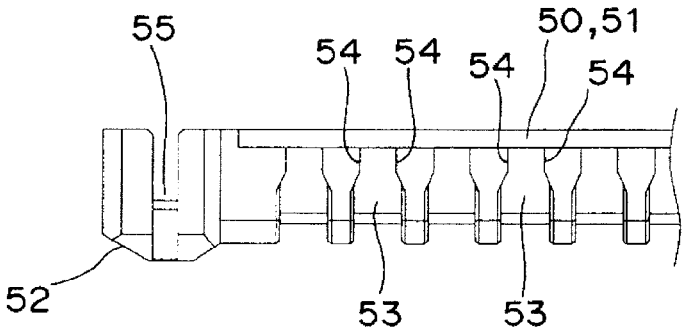
Figure 11C:
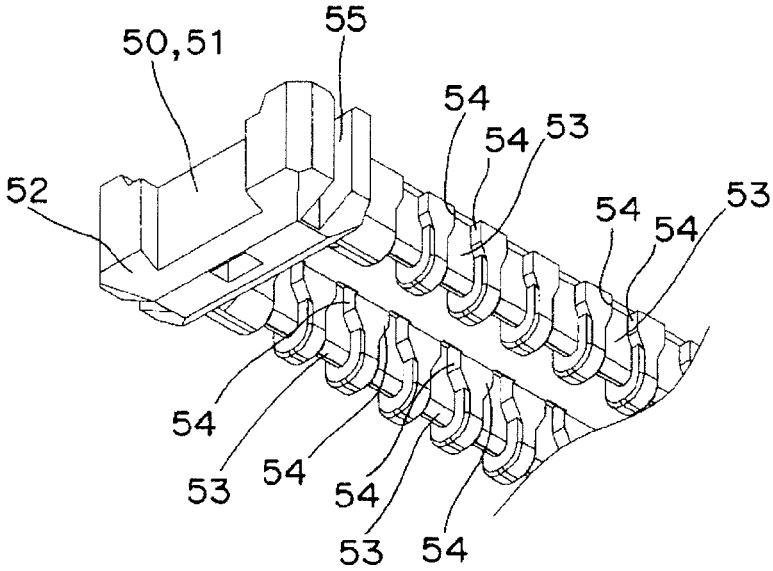
Figure 12A:
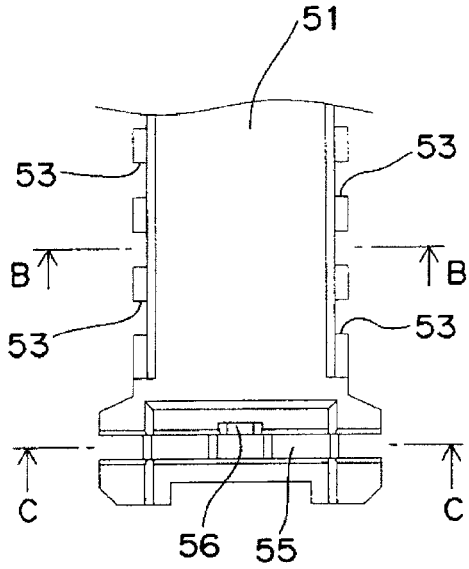
FIGS. 12A, 12B, and 12C are a partial plan view of a socket main body according to the present invention, and cross-sectional views taken along line B-B and line C-C in FIG. 12A.
Figure 12B:
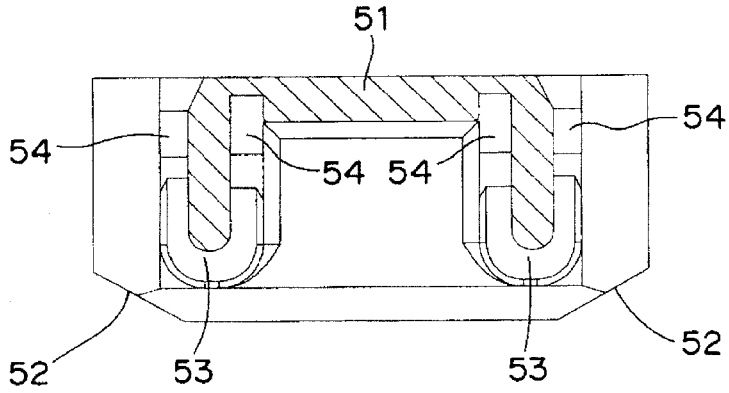
Figure 12C:
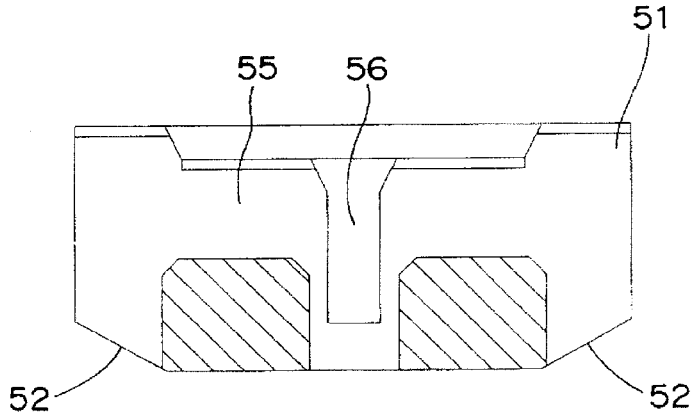
Figure 13A:
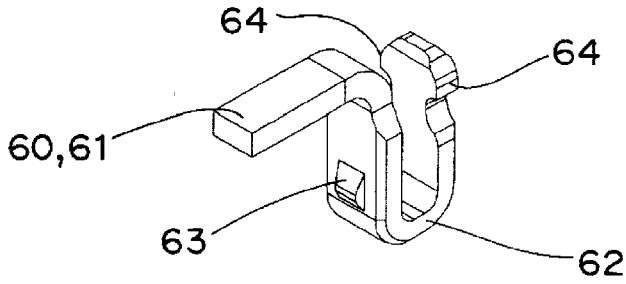
FIGS. 13A, 13B, 13C and 13D are a perspective view, a perspective view seen from a different angle, a front view, and a perspective view seen from another different angle of a second terminal shown in FIG. 4.
Figure 13B:
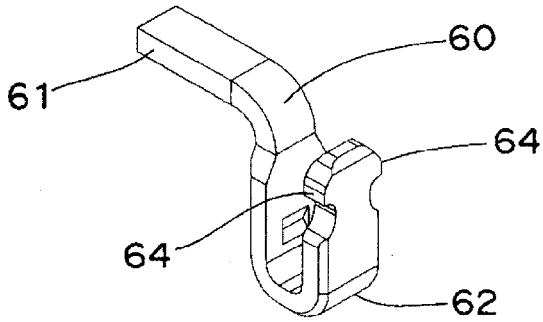
Figure 13C:
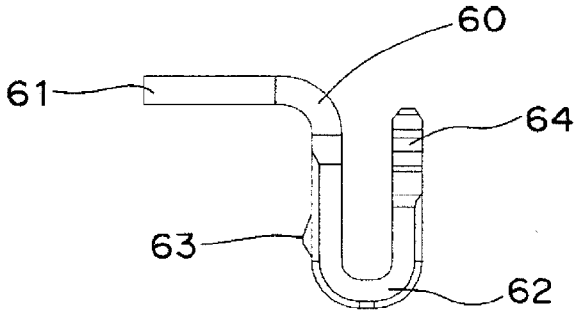
Figure 13D:
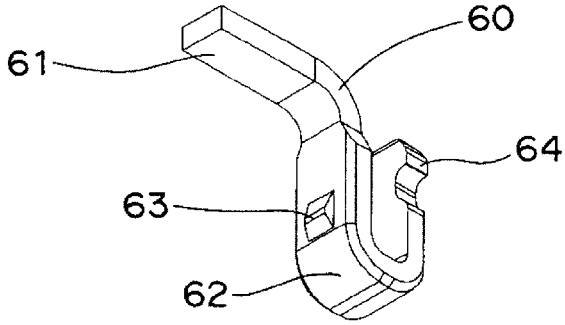
Figure 14A:
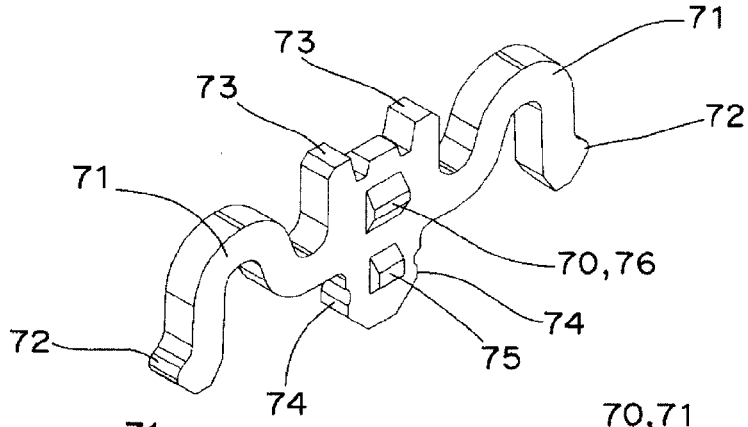
FIGS. 14A, 14B, 14C and 14D are a perspective view, a plan view, a front view, and a perspective view seen from a different angle of a second support fitting shown in FIG. 4.
Figure 14B:
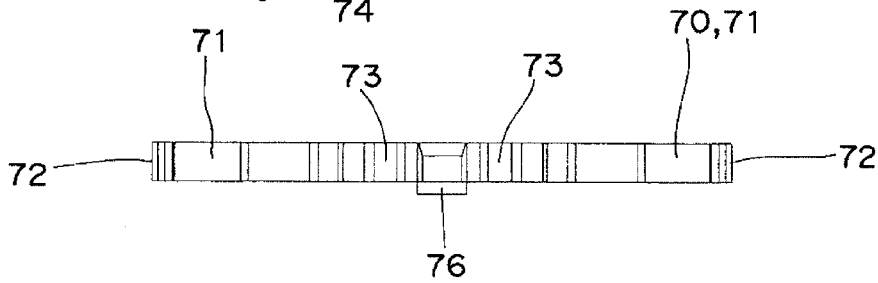
Figure 14C:
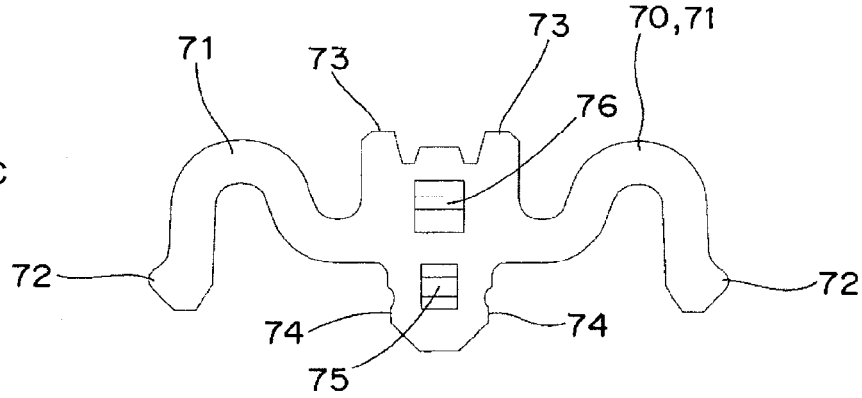
Figure 14D:
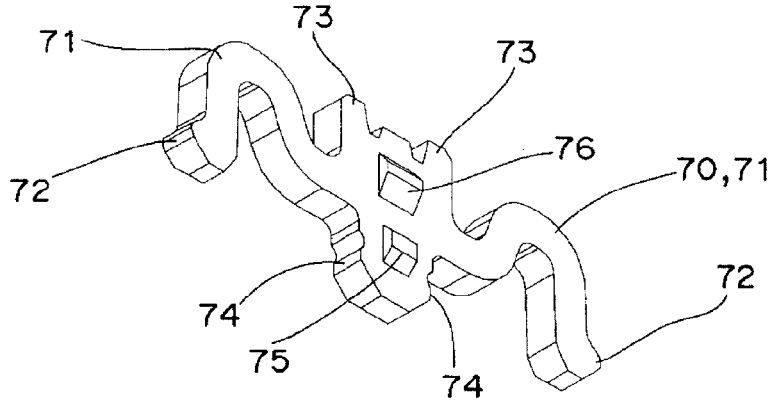

The second contact 33*a* of the first terminal 30 assembled to the socket main body 21 is in a play-fitted state in the fit-in groove 25 of the socket main body 21 (FIGS. 10A to 10C). Thus, the first terminal 30 has the free end of the elastic contact piece 33 elastically deformable, and is turnable by a very small angle. As a result, even if the part precision and the assembly precision of the plug 50 are low, position adjustment can be performed by the elastic deformation of the elastic contact piece 33 and the like. Therefore, high part precision and assembly precision are not required for the socket 20 and the plug 50, the production is facilitated, and the yield is improved, according to the present embodiment.

As shown in FIGS. 11A to 16C, the plug 50 is formed by adjacently arranging a plurality of second terminals 60, to be hereinafter described, along the opposing opening edges of the lower surface of the plug main body 51, and assembling a second support fitting 70 to both ends of the upper surface.

As shown in FIGS. 11A to 11C and FIGS. 12A to 12C, the plug main body 51 is formed in a box-shape having a shallow bottom so as to be fitted into the socket main body 21. The plug main body 51 has a guide tapered surface 52 formed at both end edges of the lower surface, and a substantially U-shaped press-fit groove 53 for press-fitting the second terminal 60, to be hereinafter described, adjacently arranged at a predetermined pitch on the opposing side walls. A pair of positioning projections 54, 54 are arranged in a projecting manner so as to face each other at the base on the outward side and the inward side of the press-fit groove 53. Furthermore, an insertion groove 55 for inserting the second support fitting 70 is formed at both ends of the plug main body 51. A guide groove 56 is formed at the middle of the inner side surface on the inward side of the inner side surface of the insertion groove 55.

As shown in FIGS. 13A to 13D, the second terminal 60 includes a substantially U-shaped second press-fit portion 62 formed by bending a portion extending from a second connecting portion 61. The second press-fit portion 62 has a click-feeling projection 63 formed through extrusion processing at the outer side surface on the second connecting portion 61 side, and positioning nails 64, 64 formed at both side edges of the free end. Furthermore, the Ni plating (not shown) is performed on the base of the second press-fit portion 62 to prevent rise of the solder.

As shown in FIGS. 14A to 14D, the second support fitting 70 has a click-feeling lock nail 72 formed at the respective distal ends of a pair of elastic arms 71, 71 extending from both side edges. The second support fitting 70 has a pair of fixing portions 73, 73 arranged projecting to the upper side from the edge on the upper side, and positioning projections 74, 74 arranged at both side edges on the lower side than the elastic arm 71. Furthermore, the central part of the second support fitting 70 is performed with extrusion processing, so that positioning projecting portions 75, 76 are arranged lined in the up and down direction. The positioning projecting portion 75 has a narrower width than the positioning projecting portion 76, and thus can be easily inserted to the guide groove 56 of the plug main body 51.

Figure 15A:
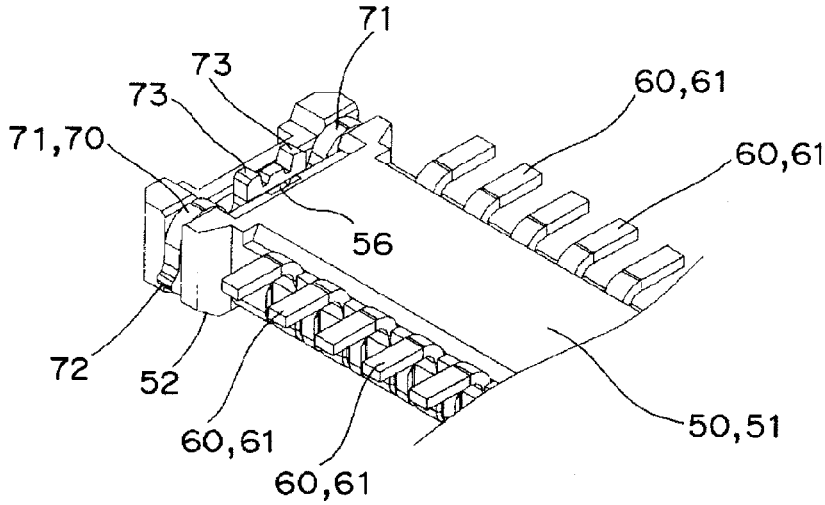
FIGS. 15A, 15B, and 15C are a partial perspective view, a partial front view, and a partial perspective view seen from a different angle of a plug in which the second terminal and the second support fitting are assembled to the plug main body.
Figure 15B:
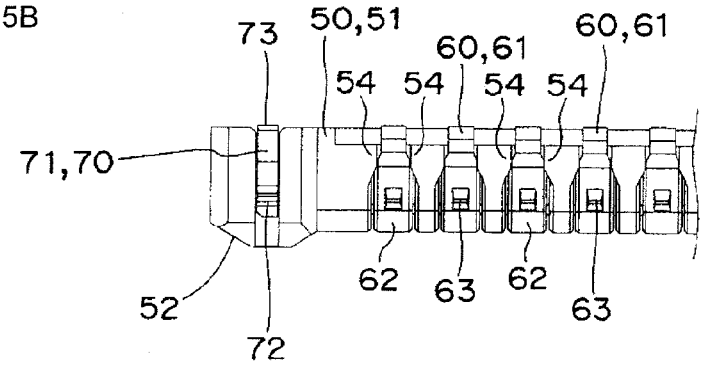
Figure 15C:
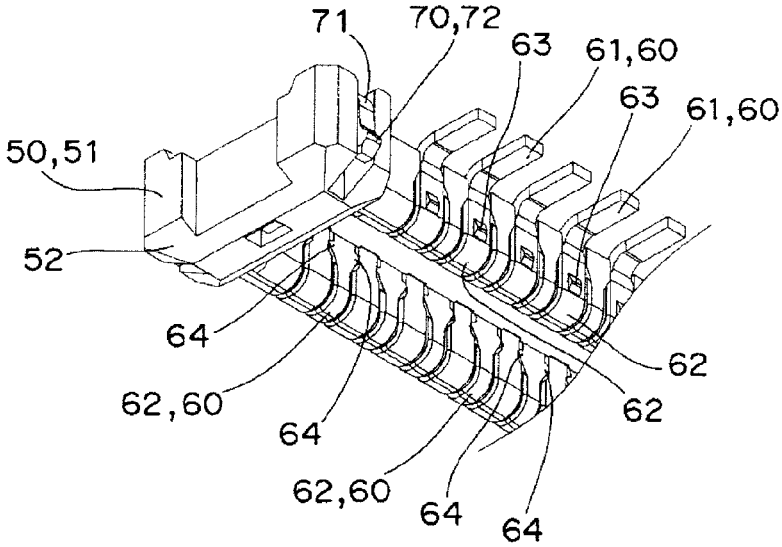
Figure 16A:
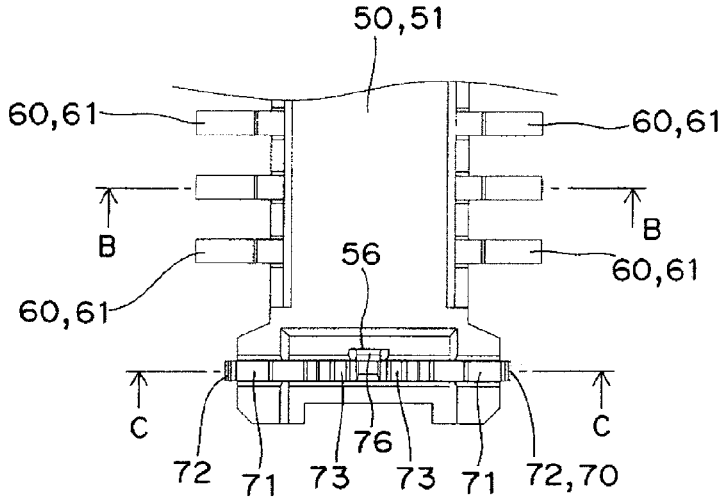
FIGS. 16A, 16B, and 16C are partial plan view of a plug in which the second terminal and the second support fitting are assembled to the plug main body, and cross-sectional views taken along line B-B and line C-C in FIG. 16A.
Figure 16B:
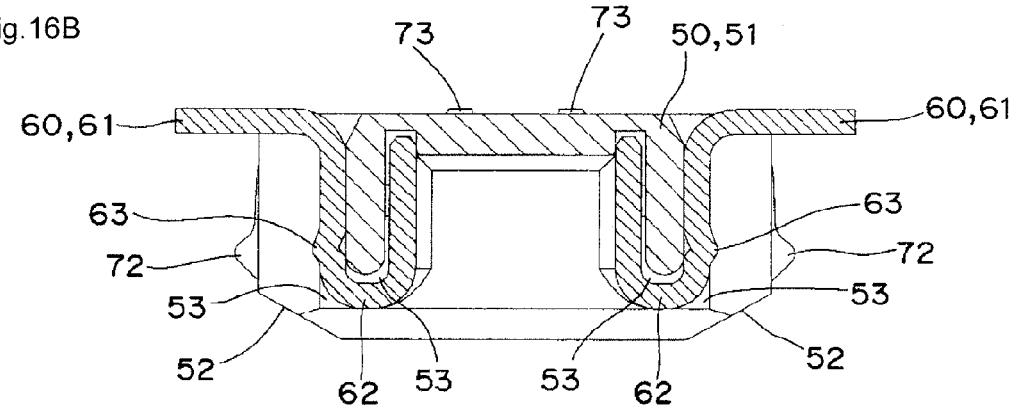
Figure 16C:
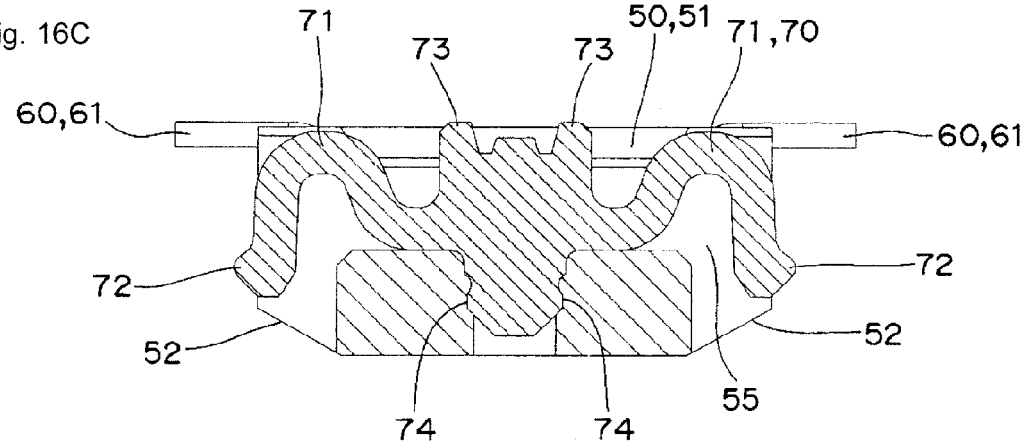
Figure 17A:
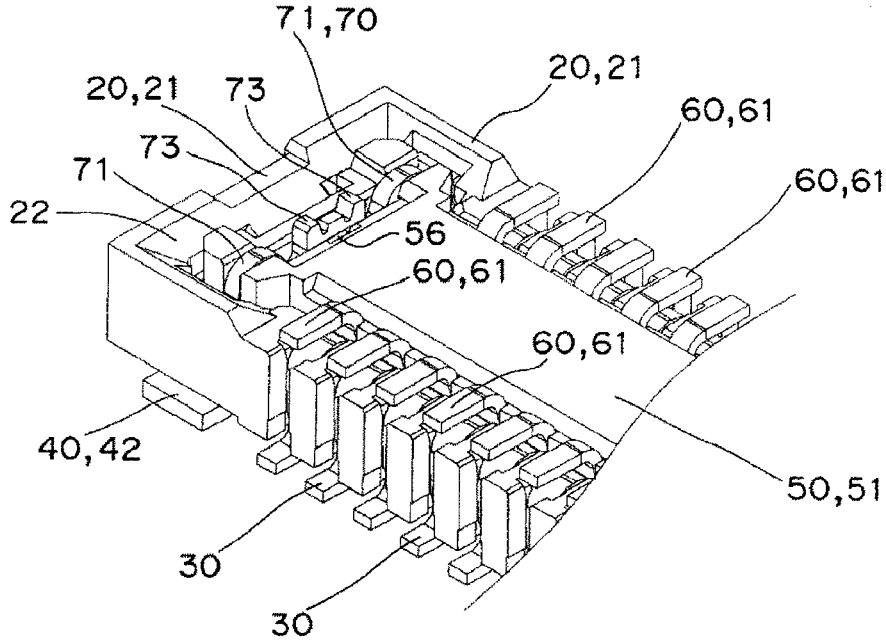
FIGS. 17A, 17B, and 17C are a partial perspective view, a partial front view, and a partial perspective view seen from a different angle showing a state in which the plug is assembled to the socket.
Figure 17B:
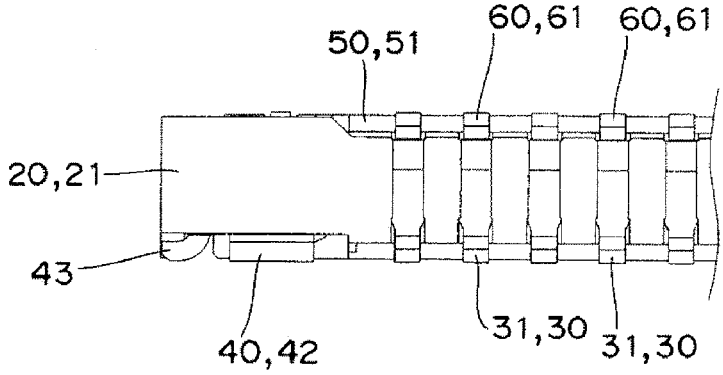
Figure 17C:
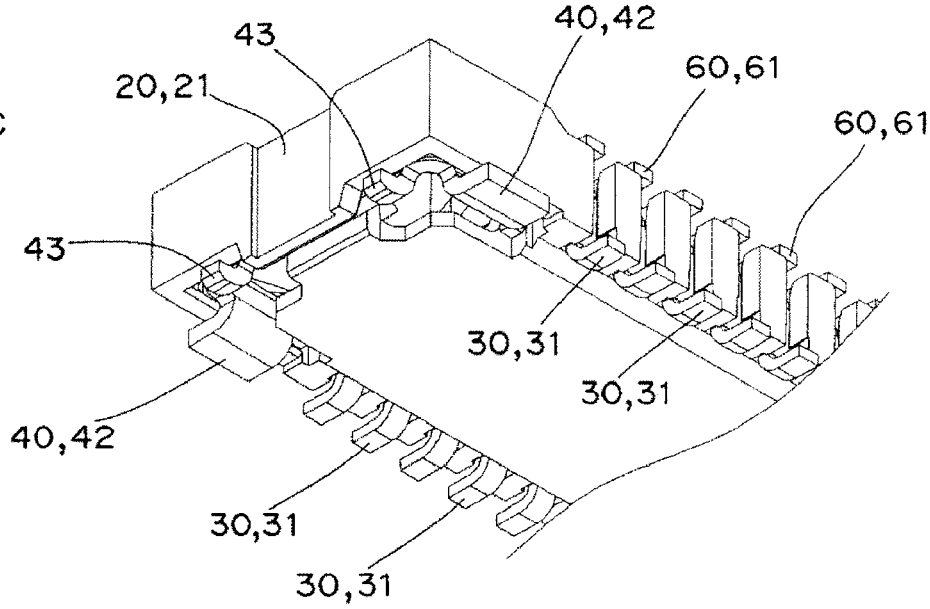

As shown in FIGS. 15A to 15C and FIGS. 16A to 16C, the second press-fit portion 62 of the second terminal 60 is press-fit and assembled to the press-fit groove 53 of the plug main body 51, and the second terminal 60 is locked to the positioning projection 54 of the plug main body 51 and retained (FIG. 16B). The second support fitting 70 is then inserted to the insertion groove 55 of the socket main body 51. The positioning projecting portions 75, 76 of the second support fitting 70 are sequentially fitted into and press-fit to the guide groove 56 of the socket main body 51, and the positioning projections 74, 74 are locked to the socket main body 51 to be retained (FIG. 16C).

According to the present embodiment, the upper end face of the second terminal 61 of a second connection terminal 60 and the upper end of the fixing portion 73 of the second support fitting 70 are in plane, and the plug 50 can be strongly soldered to the printed circuit board 11.

As the positioning projecting portion 75 has a narrower width than the positioning projecting portion 76, and can be easily fitted into the guide groove 56, the assembly task of the second support fitting 70 is facilitated.

As the positioning projecting portion 76 has a larger width dimension than the positioning projecting projection 75 and closely attaches to the inner side surface of the guide groove 56, the horizontal shift of the second support fitting 70 can be prevented.

Figure 1:
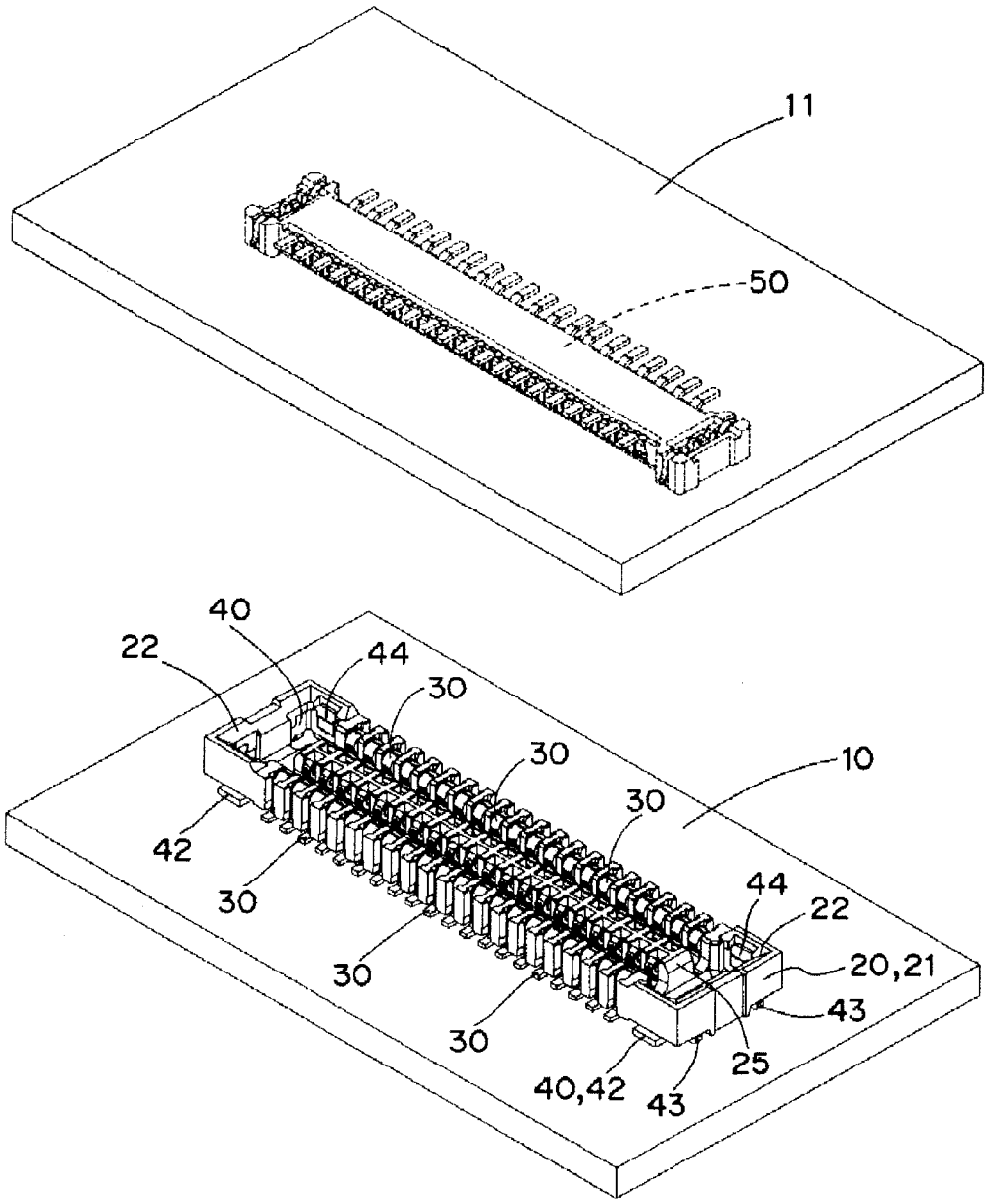
FIG. 1 is a perspective view showing a socket and a plug attached to printed circuit boards.
Figure 2:
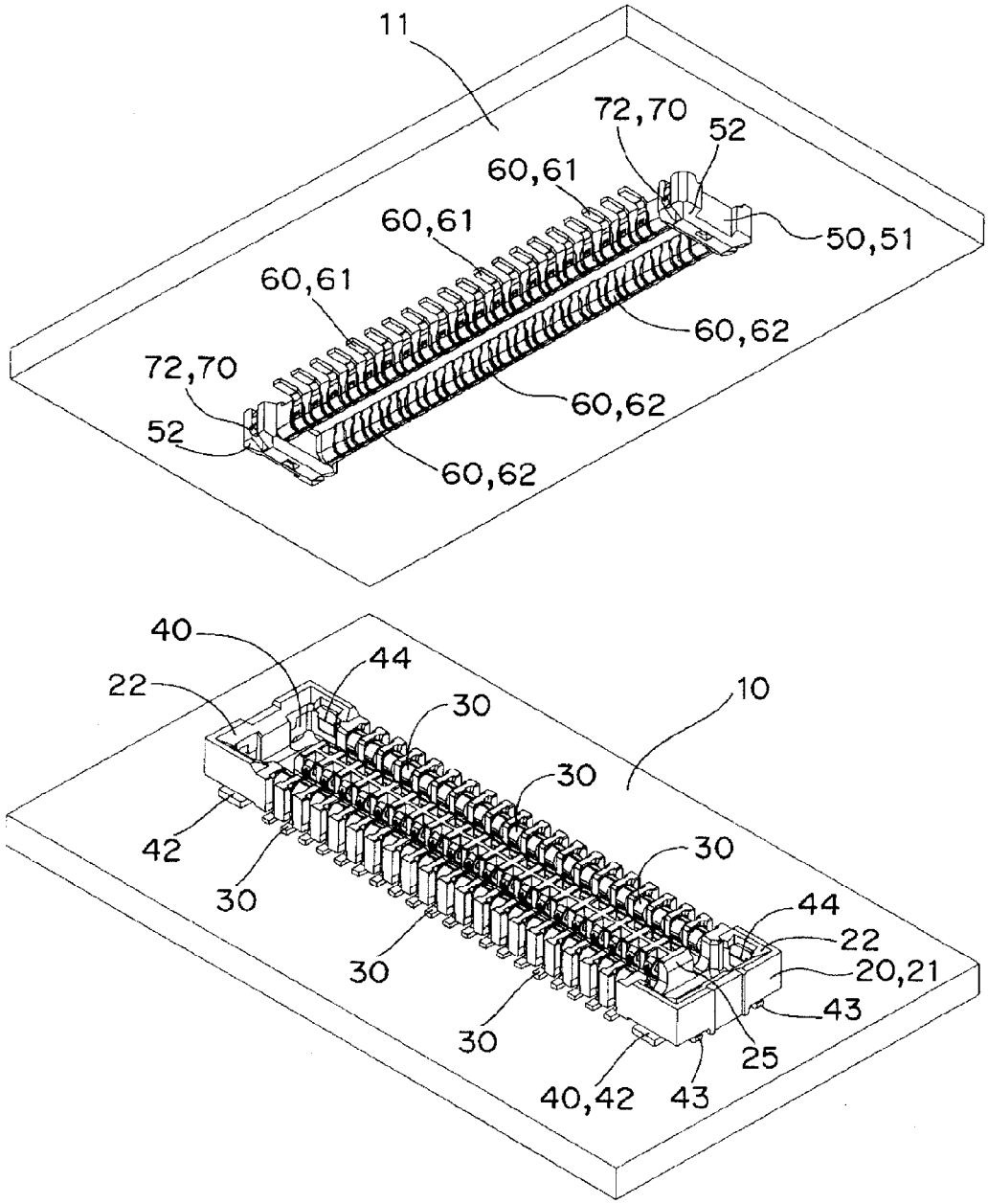
FIG. 2 is a perspective view seen from a different angle showing the socket and the plug attached to the printed circuit boards.
Figure 3A:
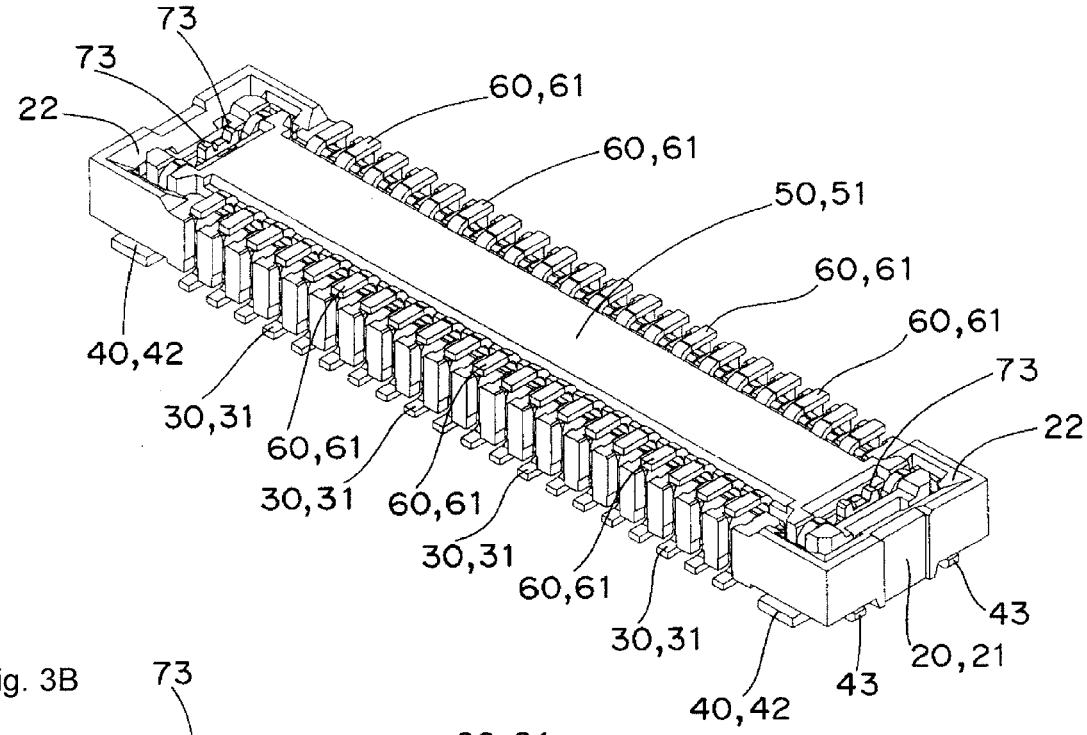
FIGS. 3A and 3B are perspective views each showing before connection and after connection of a connector according to the present invention.
Figure 3B:
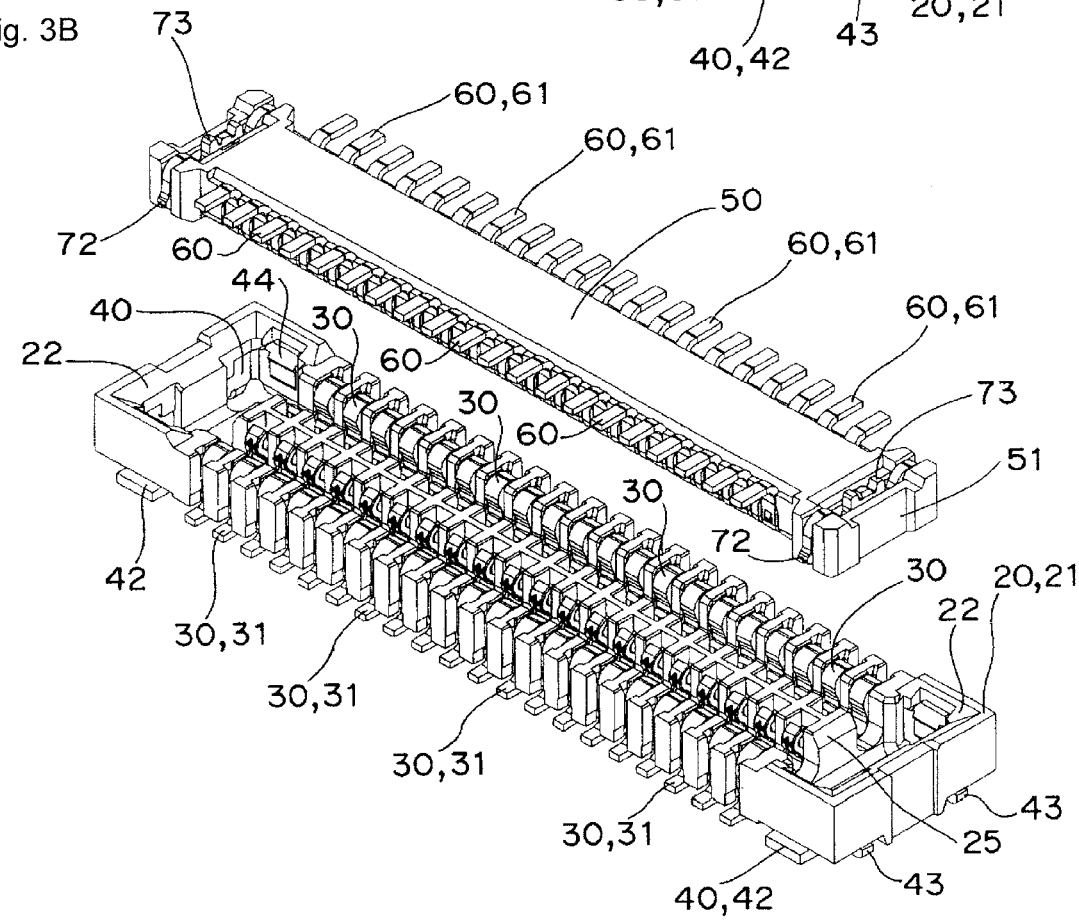

As shown in FIGS. 1 and 2, when connecting the socket 20 and the plug 50, the plug 50 mounted to the lower surface of the printed circuit board 11 is arranged above the socket 20 mounted to the upper surface of the printed circuit board 10. The guide tapered surface 22 arranged at the opening edge of the socket main body 21 and the guide tapered surface 52 arranged at the outer peripheral edge of the plug main body 51 are contacted for rough positioning. The plug 50 is then lowered, and the plug 50 is pushed in while spreading the elastic contact piece 33 of the first terminal 30 with the second press-fit portion 62 of the second terminal 60. The click-feeling projection 63 of the second terminal 60 rides over the first contact 32*a* that is bulging out, and at the same time, the click-feeling lock nail 72 of the second support fitting 70 rides over the click-feeling projection 44 of the first support fitting 40. The first contact 32*a* and the second contact 33*a* of the first terminal 30 respectively pressure contact the second press-fit portion 62 of the second terminal 60, and the connection task is completed.

As shown in FIG. 15A, according to the present embodiment, both ends of the second fit-in portion 62 of the second terminal 60 are engaged to and retained at the pair of positioning projection 54 arranged at the press-fit groove 53 of the plug main body 51. Thus, the second connection terminal 60 does not fall out, and the position precision is high. As a result, the contact pressure between the first terminal 30 and the second terminal 60 becomes even. Furthermore, the adjacent second press-fit portions 62, 62 do not contact as the second press-fit portion 62 does not shift horizontally.

Figure 18A:
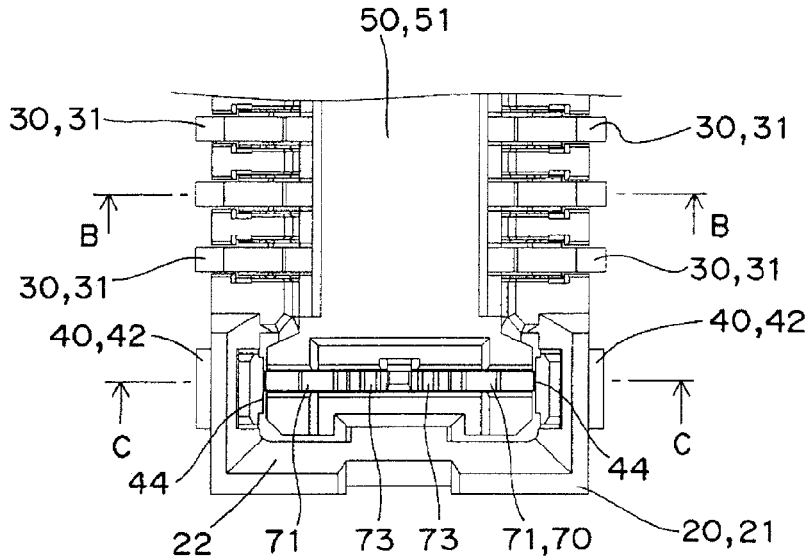
FIGS. 18A, 18B, and 18C are a partial plan view showing a state in which the plug is assembled to the socket, and cross-sectional views taken along line B-B and line C-C in FIG. 18A.
Figure 18B:
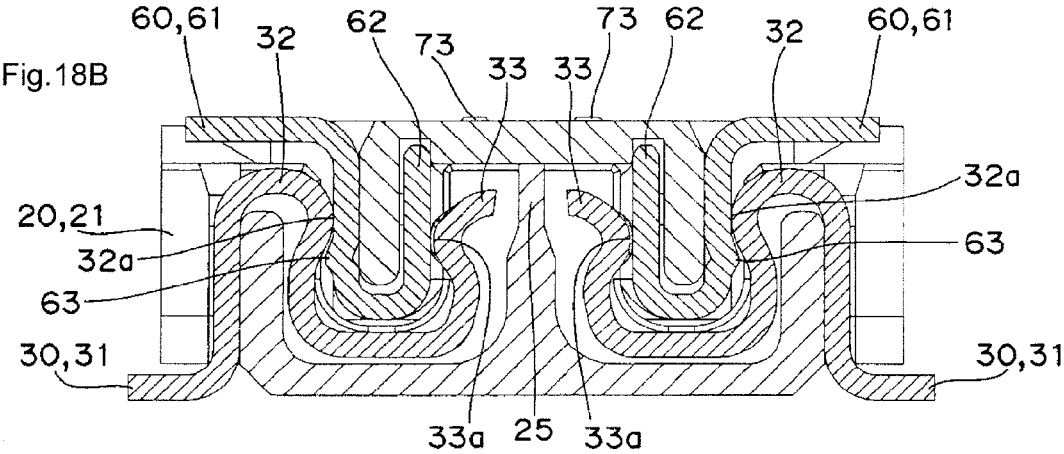
Figure 18C:
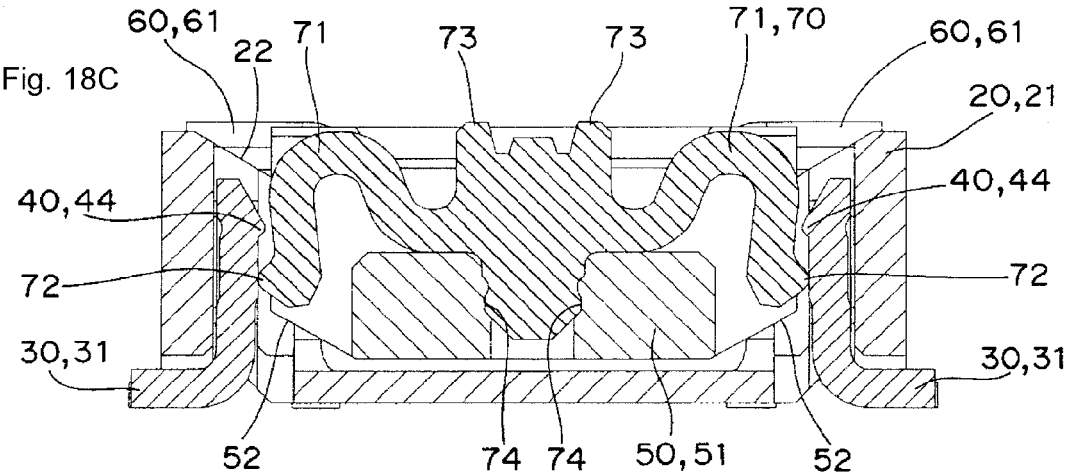

As shown in FIG. 18B, according to the present embodiment, the second press-fit portion 62 of the second terminal 60 arranged with the click-feeling projection 63 is press-ft between the first and second contacts 32*a*, 33*a*. Furthermore, the second support fitting 70 including the click-feeling lock nail 72 engages over the click-feeling projection 44 of the first support fitting 40. Thus, the withdrawing force of the plug 50 is large, the connection state can be checked with the click feeling, and the worker can feel a sense of safety.

The click-feeling projection 63 of the second terminal 60 is tangent to the first contact 32*a* arranged along the curved surface, and the withdrawing force further increases.

As the elastic contact piece 33 of the first terminal 30 outwardly biases the second press-fit portion 62 of the second terminal 60, the click-feeling projection 63 of the second press-fit portion 62 more strongly contacts to the first contact 32*a* while engaging the same, thereby enhancing the contact reliability.

Figure 7A:
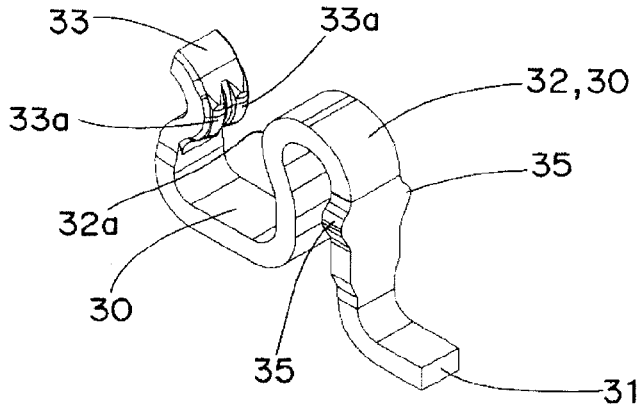
FIGS. 7A, 7B, 7C, and 7D are a perspective view, a plan view, a front view, and a perspective view seen from a different angle of a first terminal shown in FIG. 4.
Figure 7B:
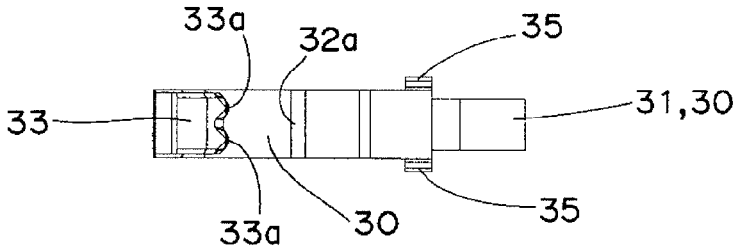
Figure 7C:
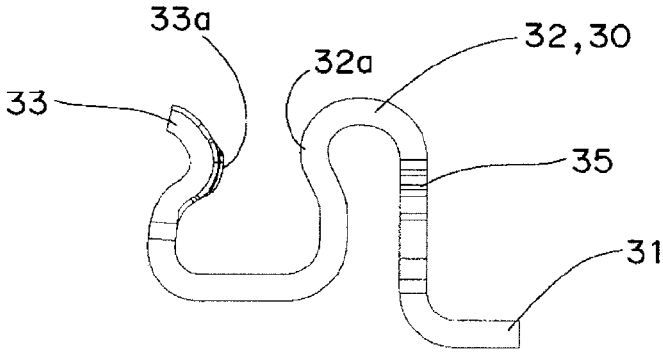
Figure 7D:
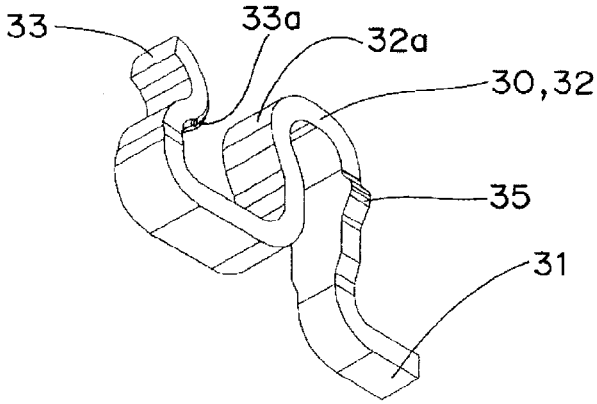
Figure 8A:
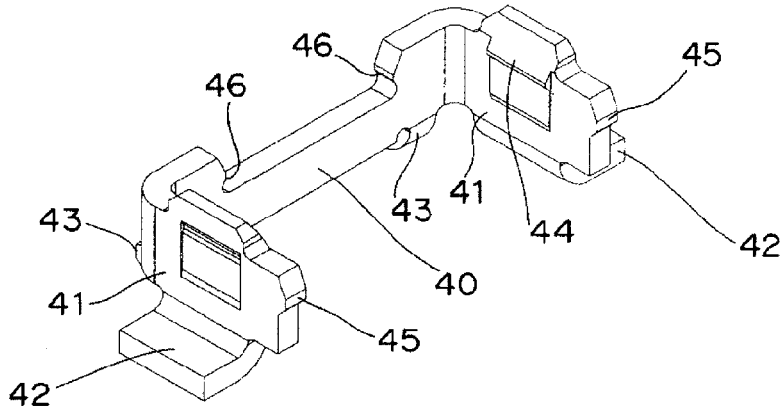
FIGS. 8A, 8B, 8C, and 8D are a perspective view, a plan view, a front view, and a perspective view seen from a different angle of a first support fitting shown in FIG. 4.
Figure 8B:
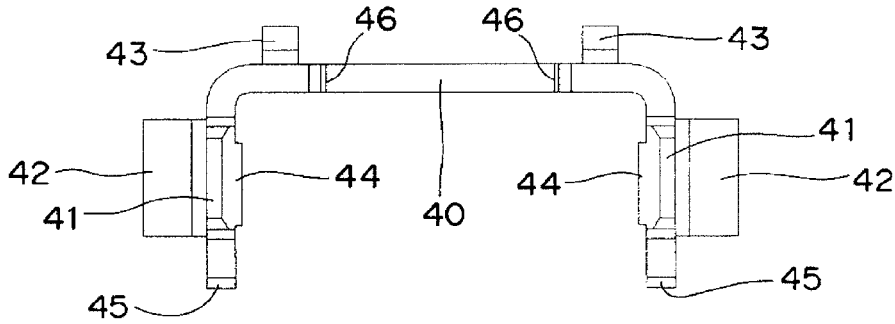
Figure 8C:
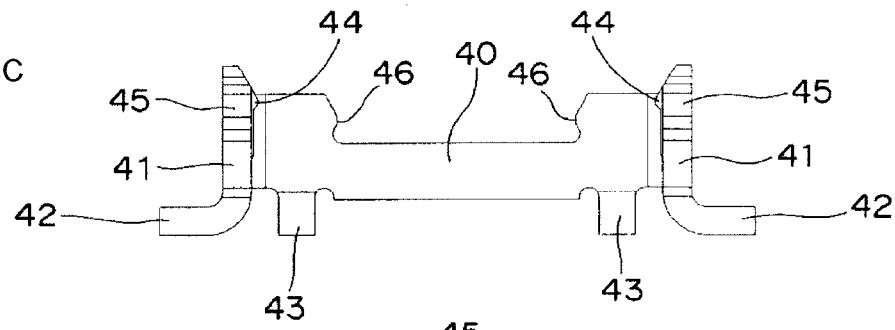
Figure 8D:
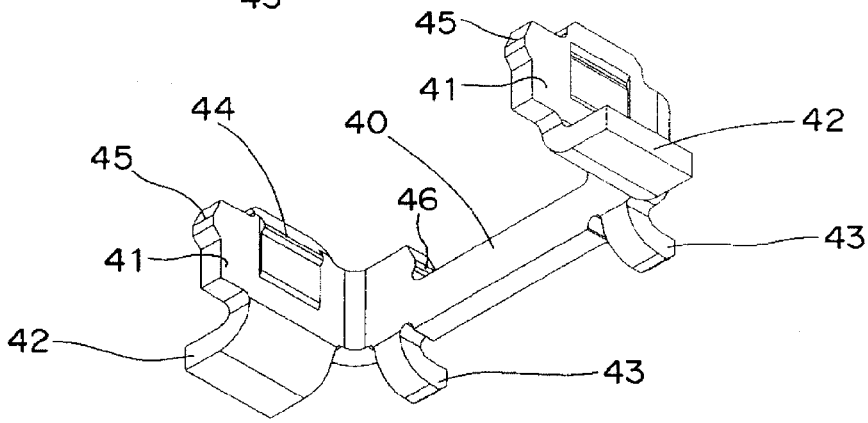

As shown in FIG. 7A, the second contact 33*a* of the first terminal 30 has a twin-dimple structure, and the contacting surface of the second press-fit portion 62 of the second terminal 60 has a smooth surface. Thus, two-point contact can always be ensured, and the contact reliability is high even if the elastic contact piece 33 and the second press-fit portion 62 horizontally shift with respect to each other in the width direction.

The elastic contact piece 33 of the first terminal 30 is elastically deformable, and can turn by a very small angle. After the lower end of the second press-fit portion 62 contacts the second contact 33*a*, it is deeply pushed in, whereby the wiping effect is obtained at the second contact 33*a* of the twin-dimple structure.

The connector according to the present invention is not limited to a case of connecting hard printed circuit boards, and is also applicable to a case of connecting hard and/or soft printed circuit boards.

The invention claimed is:

1. A connector comprising:

a plug mounted on a lower surface of a printed circuit board; and a socket mounted on an upper surface of another printed circuit board;

wherein the plug is fitted in and electrically connected to the socket, wherein a second support fitting is attached to both ends of a plug main body of the plug and is fixed to the printed circuit board, wherein a first support fitting is attached to both ends of a socket main body of the socket and fixed to the another printed circuit board, and wherein the second support fitting is engaged to the first support fitting, and wherein the first support fitting has a substantially horseshoe cross-sectional shape in a plane perpendicular to a direction of insertion of the plug into the socket.

2. The connector according to claim 1, wherein a lock nail provided at a free end of an elastic arm extending from at least an edge on one side of the second support fitting locks to a lock receiving portion provided on an inner side surface of at least one side of the opposing inner side surface of the first support fitting.

3. The connector according to claim 2, wherein the lock nail provided at the free end of the elastic arm extending from edges on both sides of the second support fitting locks to the lock receiving portion provided on the opposing inner side surface of the first support fitting.

4. The connector according to claim 2, wherein the lock nail of the second support fitting locks to a lock receiving portion of the first support fitting to obtain a click feeling.

5. The connector according to claim 1, wherein a positioning projection which engages the plug main body for retention is formed at the edges on both sides of a positioning projecting portion formed by performing extrusion processing on the second support fitting and fitted to a guide groove of the plug main body.

6. The connector according to claim 1, further comprising a first positioning projecting portion and a second positioning projecting portion disposed below the first positioning projecting portion, wherein the first and second positioning projecting portions are formed by performing extrusion processing on the second support fitting and fitted to the guide groove of the plug main body, and wherein the second positioning projecting portion has a narrower width than the first positioning projecting portion.

7. The connector according to claim 1, wherein a push-in amount of a first terminal for electrical connection is the same as a push-in amount of the first support fitting for retention.

* * * * *